United States Patent [19]

Bailey

[11] 3,968,532

[45] July 13, 1976

[54] KNOCK DOWN BOAT CONSTRUCTION

[75] Inventor: Alfred Bailey, Orchard Park, N.Y.

[73] Assignee: Kar-Ta-Craft Corporation, East Aurora, N.Y.

[22] Filed: Mar. 7, 1975

[21] Appl. No.: 556,214

[52] U.S. Cl. ..... 9/2 C; 114/61

[51] Int. Cl.[2] ..... B63B 7/00

[58] Field of Search ..... 9/2 R, 2 C, 2 S, 2 A, 9/2 F; 114/61, 66.5 F

[56] References Cited

UNITED STATES PATENTS

| | | | |
|---|---|---|---|
| 907,629 | 12/1908 | Murphy | 9/2 F |
| 2,745,118 | 5/1956 | Potts et al. | 114/61 |
| 3,045,263 | 7/1962 | Blachly | 114/66.5 F |
| 3,548,773 | 12/1970 | Laughlin | 114/61 |
| 3,613,136 | 10/1971 | Cogliano | 9/2 S |
| 3,614,937 | 10/1971 | Schulman | 114/66.5 F |

*Primary Examiner*—Trygve M. Blix
*Assistant Examiner*—Stuart M. Goldstein
*Attorney, Agent, or Firm*—Bean & Bean

[57] ABSTRACT

A boat is formed with a pair of separate, fore and aft extending deck halves to each of which is secured a pontoon; the deck halves being releasably secured together by a bridging front locking plate and a bridging rear locking-motor mounting plate, and have their deck surfaces maintained in an essentially coplanar relationship by removably passing tubes of circular cross section through pairs of deck half affixed tubes of square cross section, which are automatically aligned incident to attachment of the bridging pieces. The deck halves are designed to provide maximum strength-minimum weight construction.

8 Claims, 4 Drawing Figures

Fig. 2.
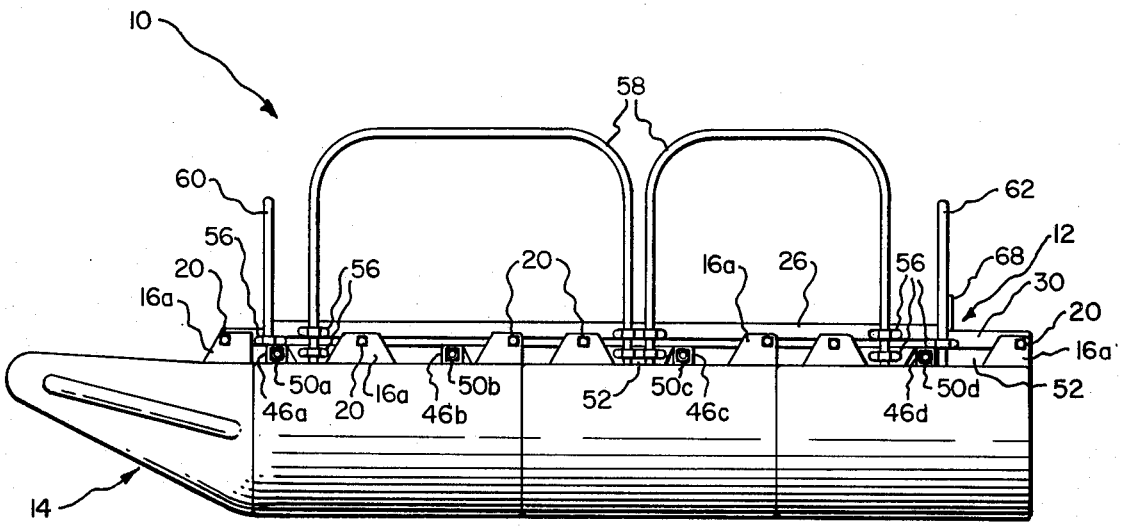
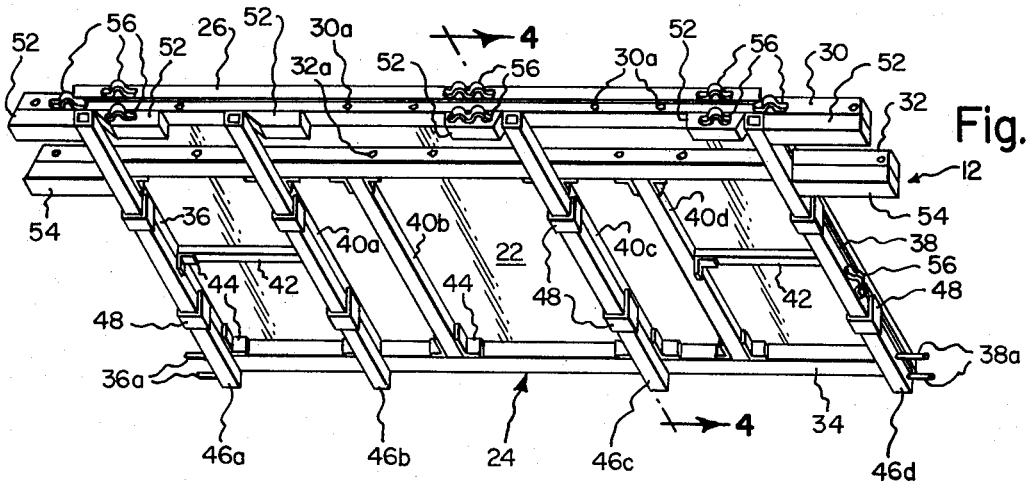
Fig. 3.
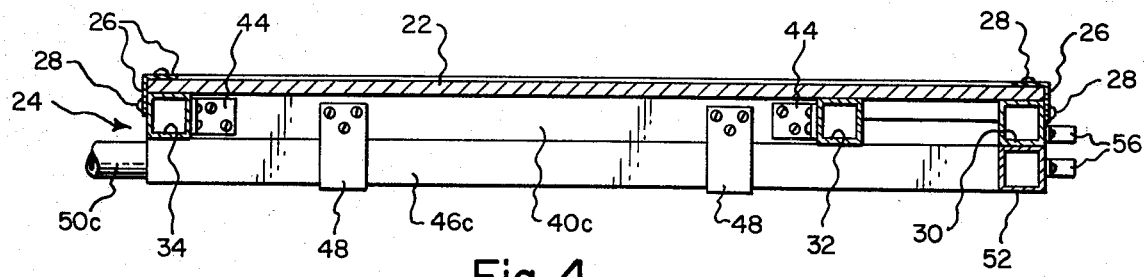
Fig. 4.

KNOCK DOWN BOAT CONSTRUCTION

BACKGROUND OF THE INVENTION

Numerous designs have been proposed for knock down or collapsable pontoon or float supported boats in order to facilitate storage and/or transportation thereof to and from a body of water, as evidenced for example by prior U.S. Pat. Nos. 907,629; 2,745,118; 3,061,845; 3,083,382; 3,179,960; 3,257,987 and 3,613,136.

SUMMARY OF THE INVENTION

The present invention is directed towards a knock down boat construction including a pair of generally rectangular, fore and aft extending deck halves each having a pontoon boat supporting device, which is fixed to its bottom along its outboard side edge, and means defining a plurality of parallel guide openings, which are of essentially square cross section and extend between its outboard and inboard side edges. The guide openings of one of the deck halves are arranged for end alignment with the guide openings of the other of the deck halves thereby to form a continuous guide opening extending between the outboard side edges when the inboard side edges are removably clamped together in vertical and horizontal alignment by plates bridging between the deck halves adjacent both fore and aft edges thereof. A plurality of cylindrical stabilizing tubes, which are transversely dimensioned to be loosely slide and rotatably fitted one within each of the continuous guide openings and have lengths corresponding essentially to the lengths of the continuous guide openings, are adapted to be automatically clamped against wall surfaces of the continuous guide openings to prevent lengthwise displacements thereof by the tendency of the inboard side edges of the deck halves to move from alignment in a direction downwardly and about their pontoon devices upon the application of loading to the upper surfaces of the deck halves.

DRAWINGS

The nature and mode of operation of the present invention will now be more fully described in the following detailed description taken with the accompanying drawings wherein:

FIG. 2 is a side elevational view of the assembled boat;

FIG. 3 is a perspective view of one of the deck halves, as viewed from the bottom; and FIG. 4 is a sectional view taken generally along the line 4—4 in FIG. 3.

DETAILED DESCRIPTION

Figure 1:
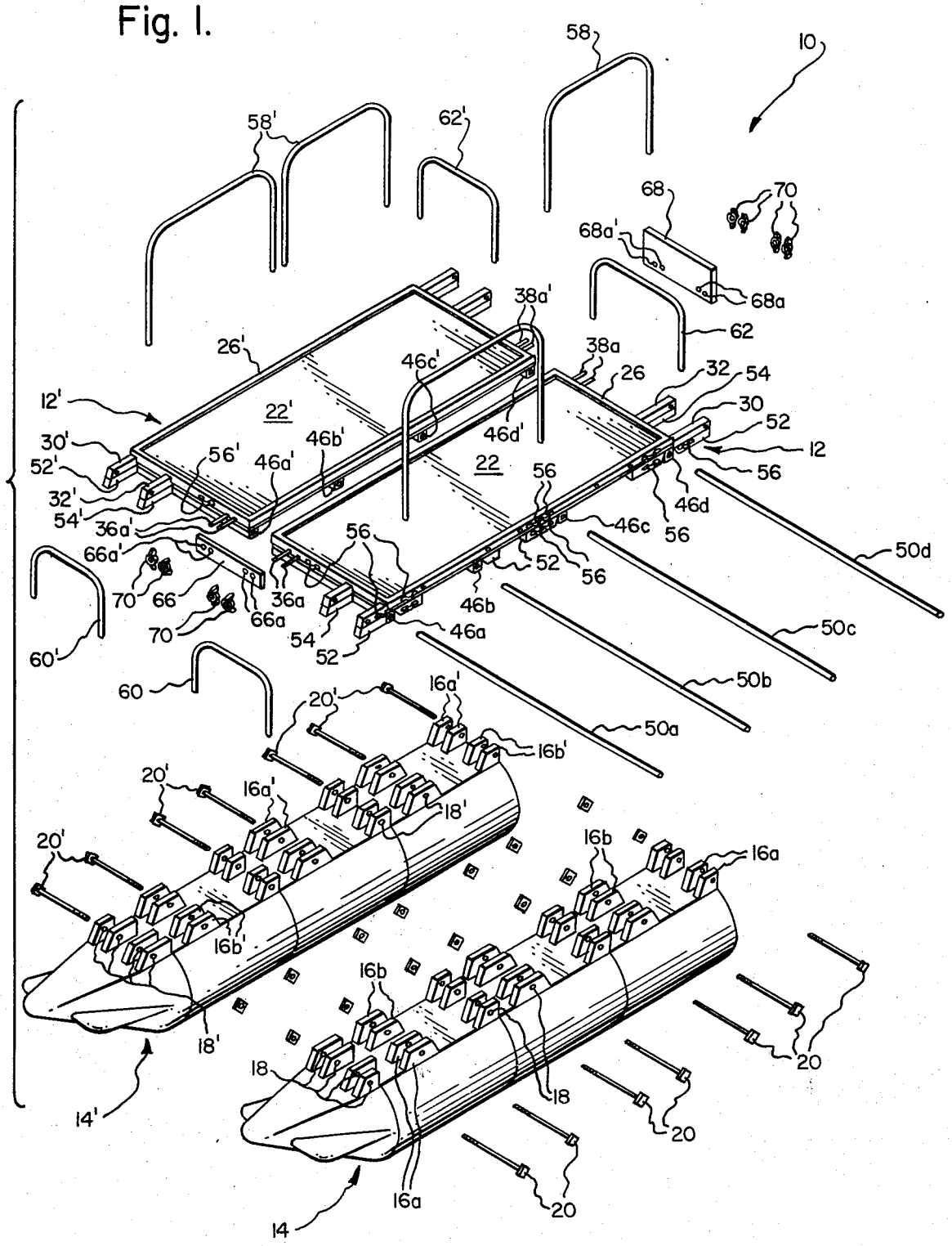
FIG. 1 is an exploded perspective view of the boat construction of the present invention.

Reference is now made particularly to FIGS. 1 and 2, wherein a knock-down boat construction in accordance with the present invention is generally designated as 10. Boat 10 includes a pair of fore and aft extending, generally rectangular deck halves 12 and 12', which are of essentially mirror image construction and rigidly fixed one to each of a pair of float devices 14 and 14' along relatively outboard side edges thereof. The specific construction of float devices 14 and 14' forms no part of the present invention, except that they are preferably of relatively light weight, multiple-section construction and are each formed with two groups of pairs of upstanding lugs 16*a*, 16*b* and 16*a'*, 16*b'*. The pairs of lugs 16*a* or 16*a'* of one group are shown as being aligned with pairs of lugs 16*b* or 16*b'* of the other group and as having through openings 18 or 18' dimensioned to receive bolt fastener devices 20 or 20' for use in rigidly securing the float devices to the deck halves.

In that deck halves 12 and 12' are of like construction, specific reference is made only to deck half 12, which is shown in FIGS. 1–4 as including a single, rectangular and relatively rigid deck panel 22, such as may be defined by a piece of ¾ inch marine grade plywood, which is peripherally clamped to a metal base frame 24, as for instance by L-shaped extrusions 26 and fastener devices 28 shown in detail only in FIG. 4. Base frame 14 includes a pair of fore-aft extending float mounting members 30 and 32 and a relatively inboard fore and aft extending member 34, which is arranged parallel to members 30 and 32 and has its opposite ends arranged to abut against transversely extending fore and aft members 36 and 38, respectively. Member 30 is transversely sized to be received between pairs of lugs 16*a*, whereas member 32 is transversely sized to be received between pairs of lugs 16*b*, and thus the distance between such members is determined by the spacing between these pairs of lugs. As best shown in FIG. 3, members 30 and 32 are formed with aligned openings 30 *a* and 32*a* to receive bolts 20. Members 36 and 38 have their outer ends arranged to abut against the inner side surface of innermost member 32 and carry mounting devices, such as pairs of threaded bolts 36*a* and 38*a*, respectively.

Also, base frame 24 preferably includes four transversely extending additional bracing members 40*a*–40*d*, which are arranged essentially parallel to members 36 and 38, and abut against facing surfaces of members 32 and 34. If required by loading conditions and the strength of the frame members already described, one or more stringer or strengthening members 42 may be employed to provide additional fore-aft bracing between members 36, 38 and their adjacently disposed bracing members 40. The members of base frame 24 are preferably box beams and formed of a corrosive resitant, light weight material, such as marine aluminum. These members may be suitably joined, as for instance by screw or rivet affixed angles 44.

A plurality of box-beam mounting members 46*a*–46*d* are best shown in FIG. 3 as being of essentially square cross-sectional configuration and as being suitably secured, as by screw or rivet mounted U-shaped clamp devices 48 in vertical alignment with members 36, 40*a*, 40*c* and 38, respectively, to extend between the outboard and inboard side edges of deck half 12. While the primary purpose of mounting members 46*a*–46*d* is to define parallel guide openings adapted to receive deck half stabilizing tubes 50*a*–50*b*, the mounting members also serve to increase the structural rigidity of base frame 24.

In that the members of 46*a*–46*b* underlie and therefore space the bottom surface of base frame 24 from the upper surface of pontoon device 14, it is desirable to suitably attach a plurality of spacer members 52 and 54 to the lower surfaces of members 30 and 32, respectively, in order that they may cooperate with members 46*a*–46*b* for transferring in a relativley uniform manner the weight of the deck halves and boat loadings directly to the upper surface of pontoon device 14. Thus, bolts 20 need not be subjected to high shear stress. Spacer members 52 also cooperate with member 30 to provide for convenience in mounting clamps or sockets 56 into which the lower ends of side safety rails 58 may be removably fitted. If desired, similar clamps or sockets 56 may also be fixed to members 30, 36 and 38 for the purpose of removably mounting front and rear safety rails 60 and 62.

By now referring to FIG. 1, it will be understood that deck halves 12 and 12' may have their inboard edges removably fixed together in a vertical and horizontally aligned relationship by means of a front locking plate 66 and a rear locking-outboard mounting plate 68. Plates 66 and 68 are arranged to bridge between the deck halves and are formed with apertures 66*a*, 66*a'* and 68*a*, 68*a'* to removably receive bolts 36*a*, 36*a'* and 38*a*, 38*a'*, respectively. Suitable means, such as wing nuts 70, which may be quickly threaded onto these bolts, are employed for removably clamping plates 66 and 68 in place. It will be understood that plates 66 and 68 also serve to automatically align the adjacently disposed or inboard ends of mounting members 46*a*–46*d* and 46*a'*–46*d'*, whereby such members define continuous guide openings extending between the outboard side edges of the joined deck halves.

Stabilizing tubes 50*a*–50*d* are essentially cylindrical and formed of a length, which is preferably equal to or slightly in excess of the combined lengths of their associated mounting members in order to permit gripping of ends of such tubes when essentially fully inserted within their associated mounting members. The stabilizing tubes are also formed with a diameter, which permits them to be easily rotated and slid lengthwise of their associated mounting tubes, when loadings are removed from the upper surfaces of joined deck halves 12 and 12'.

It is intended that pontoons 14 and 14' will normally be permanently secured to deck halves 12 and 12', whereby to form a pair of L-shaped units, whereas safety rails 58, 58' and 60, 60' and 62, 62'; plates 66 and 68; and stabilizing tubes 50*a*–50*d* will be readily removable in order to provide for ease in transporting and storing the overall boat structure in a knock down, space saving form. The weight and size of each unit is such that it can be readily placed on or removed from the roof rack of a car by one man. The L-shaped configuration of such units permits them to be nested in a compact relationship by merely inverting one of the units; the resultant space between the facing bottom surfaces of the deck halves of the nested units affording a convenient storage space for the safety rails, locking plates and stabilizing tubes.

One man may easily assemble the present boat construction within a few minutes by following the simple steps of placing the units on the ground with the deck halves arranged in an edge to edge relationship; attaching the units together by means of the locking plates; inserting the stabilizing tubes through their associated mounting members; and finally fitting the safety rails into place. A steerable outboard motor, not shown may be suitably attached to that portion of locking plate 68, which projects about the upper surfaces of the deck halves, in order to afford propulsion for the assembled boat. The boat may of course be disassembled or knocked down by merely reversing these steps.

It is particularly important to the understanding of the present invention that although locking plates 66 and 68 do serve to lock or clamp the deck halves together, they are not intended to maintain and indeed would not be effective in maintaining the upper surfaces of deck panels 22 in a coplanar relationship when the latter are subjected to a loading condition. Thus, when a slight load is applied to one or the other of the deck halves their inboard edges tend to move or pivot downwardly about their associated pontoon devices, and this characteristic of the construction is relied upon to frictionally clamp the otherwise freely movable stabilizing tubes within their associated mounting members, the stabilizing tubes thereafter being effective to prevent further movements of the deck halves in this manner within the rated loading of the boat. In practice, the degree of movement of the deck halves necessary to effect clamping of the stabilizing bars in place is difficuult to perceive with the naked eye. Of course as soon as a load is removed from the deck halves, stabilizing tubes can be freely pulled out of their associated mounting members, but since they are not subjected to lengthwise directed forces during normal use of the boat, there is no need to provide a mechanical latch device for retaining them in their inserted position. However, it would probably be desirable to provide a mechanical latch device for this purpose in order to avoid doubts in the mind of a user relative to the structural integrity of the boat.

The use of cylindrical stabilizing tubes within mounting members defining an essentially square cross-section guide opening or passageway, as well as the loose fitting relationship of these elements, is critical to the present boat construction, since this arrangement permits the stabilizing tubes to be inserted or removed without binding, due to accumulations of dirt or other foreign matter within the mounting members. Tests have shown that like configured elements, even when provided with a relatively loose fit, tend to freeze after a very short period of use under normal lake and river conditions.

I claim:

1. A knock down boat construction including a pair of generally rectangular deck halves each having fore and aft edges and outboard and inboard side edges, each of said deck halves having means defining a plurality of parallel guide openings of essentially square cross section, said parallel guide openings extending between said outboard and inboard side edges of said deck halves, said parallel guide openings of one of said deck halves being arranged for end alignment with said parallel guide openings of the other of said deck halves to form continuous guide openings extending between said outboard side edges when said inboard side edges are brought together in vertical and horizontal alignment; a pair of pontoon boat supporting devices fixed one to the bottom of each of said deck halves along said outboard side edges, whereby said pontoon devices are disposed in an essentially parallel relationship when said inboard side edges are disposed in alignment; means removably bridging between said deck halves adjacent both said fore and aft edges thereof for removably locking said inboard side edges in alignment; and a plurality of cylindrical stabilizing tubes transversely dimensioned to be loosely slidably and rotatably fitted one within each of said continuous guide openings, said stabilizing tubes having lengths corresponding essentially to the lengths of said continuous guide openings, and said stabilizing tubes being automatically clamped against wall surfaces of said continuous guide openings to prevent displacements thereof lengthwise of said continuous guide openings by the tendency of said inboard side edges to move from alignment in a direction downwardly and about said pontoon devices associated with their respective deck halves upon the application of loading to the upper surfaces of said deck halves.

2. A knock down boat construction according to claim 1, wherein each of said deck halves includes a generally rectangular deck panel supported by a base frame, said pontoon devices including a plurality of lugs upstanding from upper surfaces thereof and spaced apart lenthwise thereof in a fore-aft direction, said base frame being affixed to said lugs, and said parallel guide openings being defined by a plurality of box-beam members fixed to the bottom of said base frame and having outboard ends arranged vertically intermediate said base frame and said upper surfaces of said pontoon devices and intermediate said lugs in said fore-aft direction.

3. A knock down boat construction according to claim 2, wherein said lugs of each of said pontoon devices are arranged in two groups of pairs of lugs, the pairs of lugs of one of said groups being aligned in a direction transversely of said pontoon devices with the pairs of lugs of the other of said groups and the pairs of lugs of each of said groups being spaced apart lengthwise of said pontoon devices, said base frame including a pair of pontoon mounting members arranged to extend horizontally lengthwise of said pontoon devices one intermediate the paris of lugs of each of said groups of lugs, an inboard member arranged parallel to said mounting members, parallel fore and aft members extending horizontally between said inboard member and the innermost of said mounting members, and a plurality of bracing members arranged intermediate and parallel to said fore and aft members, said bracing members extending between said inboard member and said innermost of said mounting members, and said box-beam members are fixed in vertical alignment one with each of said fore and aft members and at least one of said bracing members to extend between said inboard and outboard side edges of said deck halves with which they are associated.

4. A knock down boat construction according to claim 3, wherein said fore and aft members carry bolts arranged adjacent inboard ends thereof to extend in fore and aft directions, respectively, and said means for bridging between said deck halves includes a locking plate clampingly secured on said bolts carried by said fore members of said deck halves and a locking-mounting plate clampingly secured on said bolts carried by said aft members, and said locking-mounting plate upstanding above said upper surfaces of said deck halves for providing an outboard motor mounting plate.

5. A knock down boat construction according to claim 2, wherein spacer members are arranged intermediate said base frame and said upper surfaces of said pontoon devices, said spacer members and said box-beam members bearing on said upper surfaces of said pontoon devices for transmission of deck half loadings to said upper surfaces of said pontoon devices in a relatively uniform manner lengthwise of said pontoon devices, and said spacer members cooperating with said base frame to support devices for removably attaching side safety rail members to said halves along said outboard side edges thereof.

6. A knock down boat construction according to claim 1, wherein said means bridging between said deck halves includes a front locking plate having opposite ends removably clamped one to each of said fore edges and a rear locking-mounting plate having opposite ends removably clamped one to each of said aft edges, said rear locking-mounting plate upstanding above said upper surfaces of said deck halves for providing a mounting plate for an outboard motor.

7. A knock down boat construction according to claim 1, wherein said parallel guide openings are defined by a plurality of box-beam members fixed to bottom surfaces of said deck halves, said box-beam members having open outboard ends thereof arranged adjacent said outboard side edges of said deck halves and vertically intermediate said deck halves and said pontoon devices.

8. A knock down boat construction according to claim 7, wherein said pontoon devices include a plurality of lugs upstanding from upper surfaces thereof and spaced apart lengthwise thereof in a fore-aft direction, said deck halves are fixed to said lugs, said outboard ends of said box-beam members are disposed intermediate said lugs in said fore-aft direction, and said means bridging between said deck halves includes a front locking plate having opposite ends removably clamped one to each of said fore edges and a rear locking-mounting plate having opposite ends removably clamped one to each of said aft edges, said rear locking-mounting plate upstanding above said upper surfaces of said deck halves for providing a mounting plate for an outboard motor.

* * * * *

UNITED STATES PATENT AND TRADEMARK OFFICE

CERTIFICATE OF CORRECTION

PATENT NO. : 3,968,532

DATED : July 13, 1976

INVENTOR(S) : Alfred Bailey

It is certified that error appears in the above-identified patent and that said Letters Patent are hereby corrected as shown below:

Col. 2, Line 15 - "14" should be --- 24 ---.

Claim 5:
Col. 6, Line 16 - Before "halves", --- deck --- is omitted.

Signed and Sealed this

Fifth Day of October 1976

[SEAL]

*Attest:*

RUTH C. MASON
*Attesting Officer*

C. MARSHALL DANN
*Commissioner of Patents and Trademarks*